US011705627B1

(12) United States Patent
Coutts

(10) Patent No.: US 11,705,627 B1
(45) Date of Patent: Jul. 18, 2023

(54) ANTENNA MODULE GROUNDING FOR PHASED ARRAY ANTENNAS

(71) Applicant: Amazon Technologies, Inc., Seattle, WA (US)

(72) Inventor: Gordon Coutts, Woodinville, WA (US)

(73) Assignee: Amazon Technologies, Inc., Seattle, WA (US)

( * ) Notice: Subject to any disclaimer, the term of this patent is extended or adjusted under 35 U.S.C. 154(b) by 130 days.

(21) Appl. No.: 17/187,443

(22) Filed: Feb. 26, 2021

(51) Int. Cl.
*H01Q 1/28* (2006.01)
*H01Q 1/48* (2006.01)
*H01Q 3/30* (2006.01)

(52) U.S. Cl.
CPC ..... *H01Q 1/48* (2013.01); *H01Q 1/288* (2013.01); *H01Q 3/30* (2013.01)

(58) Field of Classification Search
CPC ..... H01Q 1/28–32; H01Q 1/288; H01Q 1/48
See application file for complete search history.

(56) References Cited

U.S. PATENT DOCUMENTS 10,644,386 B2 * 5/2020 Thompson ..... H01Q 1/06
2004/0196203 A1 * 10/2004 Lier ..... H01Q 21/067 343/824
2017/0237181 A1 * 8/2017 Chen ..... H01Q 21/0025 343/702
2018/0062266 A1 * 3/2018 Haziza ..... H04B 7/08
2019/0027816 A1 * 1/2019 Marrero-Fontanez ..... H01Q 1/288
2020/0036088 A1 * 1/2020 Bongard ..... H01P 5/02

* cited by examiner

*Primary Examiner* — Hasan Islam
(74) *Attorney, Agent, or Firm* — Lowenstein Sandler LLP

(57) ABSTRACT

Technologies directed to a radio frequency (RF) structure that provides an electrically insulating gap between a ground plane of a circuit board and a chassis at direct current (DC) and an electrical connection between the ground plane and the chassis at RF frequencies. One RF structure includes a first conductor electrically coupled to the ground plane and a second conductor electrically coupled to the chassis. A physical arrangement of a portion of the first conductor and a portion of the second conductor causes the RF structure to provide an electrically insulating gap between the ground plane and the chassis at DC and an electrical connection between the ground plane and the chassis at RF frequencies.

20 Claims, 13 Drawing Sheets

ANTENNA MODULE GROUNDING FOR PHASED ARRAY ANTENNAS

BACKGROUND

A large and growing population of users is enjoying entertainment through the consumption of digital media items, such as music, movies, images, electronic books, and so on. The users employ various electronic devices to consume such media items. Among these electronic devices (referred to herein as endpoint devices, user devices, clients, client devices, or user equipment) are electronic book readers, cellular telephones, Personal Digital Assistants (PDAs), portable media players, tablet computers, netbooks, laptops, and the like. These electronic devices wirelessly communicate with a communications infrastructure to enable the consumption of digital media items. To communicate with other devices wirelessly, these electronic devices include one or more antennas.

BRIEF DESCRIPTION OF DRAWINGS

The present inventions will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Technologies directed to a radio frequency (RF) structure that provides an electrically insulating gap between a ground plane of a circuit board and a chassis at direct current (DC) and an electrical connection between the ground plane and the chassis at RF operating frequencies. One RF structure includes a first conductor electrically coupled to the ground plane and a second conductor electrically coupled to the chassis. A physical arrangement of a portion of the first conductor and a portion of the second conductor causes the RF structure to provide an electrically insulating gap between the ground plane and the chassis at DC and an electrical connection between the ground plane and the chassis at RF operating frequencies.

In some cases, an antenna module, including an antenna and RF circuitry, needs to be electrically floated from a ground of a chassis of a structure, such as a satellite chassis. That is, an integrated circuit that operates an antenna needs to be electrically isolated from a DC ground of the chassis. A conventional solution is to add a physical gap between an antenna ground and a chassis ground to electrically float an antenna module. The physical gap, however, results in poor antenna performance. Also, variations in the physical gap can have significant effects on antenna performance.

Aspects of the present disclosure overcome the deficiencies of the conventional solution by providing an RF structure in a circuit board of the antenna module. In at least one embodiment, a perimeter of the circuit board is grounded to DC ground on the chassis such that there is no physical gap between the circuit board and the chassis, and the RF structure provides at least two conductors that are physically separated in layers of the circuit board. The RF structure provides an electrically insulating gap at DC between the PCB layers and an electrical connection at the antenna's RF operating frequencies. Aspects of the present disclosure allow the antenna module to be electrically floating from the DC ground of the chassis without any physical gap and while maintaining good antenna performance. In at least one embodiment, the RF structure can be a quarter-wave RF choke that is open-circuited on one side and short-circuited on the other side at RF operating frequencies where the effective distance is equal to the one-quarter wavelength. At RF operating frequencies, the RF short circuit forms an equivalent solid ground plane for the antenna, resulting in good antenna performance that meets the desired specifications.

Figure 1:
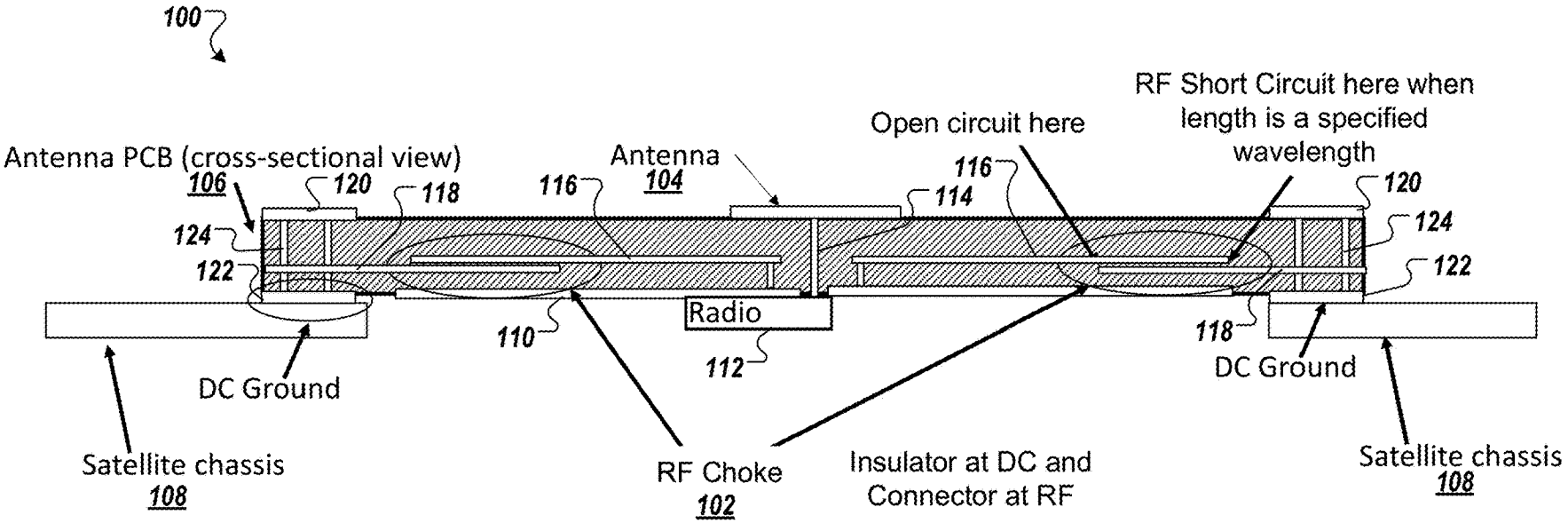
FIG. 1 is a cross-sectional view of an antenna module with an RF choke according to at least one embodiment.

FIG. 1 is a cross-sectional view of an antenna module 100 with an RF choke 102 according to at least one embodiment. Antenna module 100 can be part of an antenna array, such as a phased array antenna (not illustrated in FIG. 1). An array antenna can include tens, hundreds, or thousands of antenna elements and can be made up of multiple antenna modules that are individually manufactured and assembled as the array antenna. For example, antenna elements, such as antenna element 104, can be built upon or supported by Printed Wiring Boards (PWBs) or Printed Circuit Boards (PCBs. In general, a PWB is similar to a PCB, but without any components installed on it. The antenna modules can be manufactured using one of several techniques, including Organic substrate PWB and Low-Temperature Cofired Ceramic (LTCC) circuit. The antenna modules are often very closely spaced between each other, preventing the insertion of any other component between them The antenna modules can be attached to another substrate, such as a PWB, or structure. Each antenna module can incorporate an integer number of antenna elements.

The antenna module 100 includes a circuit board 106 coupled to a chassis 108 of a space vehicle. The space vehicle can be a satellite, a high-altitude vehicle, or space station, or the like. Alternatively, chassis 108 can be part of other structures. The chassis 108 is electrically grounded at a first ground potential. The circuit board 106 includes a ground plane 110 that is electrically grounded at a second ground potential. The antenna element 104 is located on a first surface of the circuit board 106 and an integrated circuit 112 (e.g., radio)) is located on a second surface of the circuit board 106. The integrated circuit 112 includes RF circuitry that is coupled to the antenna element 104 through a first via 114 in the circuit board 106. The integrated circuit 112 is also coupled to the ground plane 110.

In at least one embodiment, the circuit board 106 is physically coupled to the chassis 108 at a perimeter of the circuit board 106. As illustrated in FIG. 1, there is no physical gap between the circuit board 106 and the chassis 108. The RF choke 102 can be formed by a first planar conductor 116 located in a first layer of the circuit board 106 and a second planar conductor 118 located in a second layer of the circuit board 106. The first planar conductor 116 is electrically coupled to the ground plane 110, the second planar conductor 118 is electrically coupled to the first ground potential of the chassis 108, and a portion of the first planar conductor 116 and a portion of the second planar conductor 118 overlap horizontally by an effective distance of a specified wavelength (e.g., a quarter wavelength, three-quarter wavelength, or the like). The RF choke 102 provides i) an electrically insulating gap between the ground plane 110 and the chassis 108 at direct currents (DC) and ii) an electrical connection between the ground plane 110 and the chassis 108 at RF operating frequencies of the integrated circuit 112.

In at least one embodiment, as illustrated in FIG. 1, the RF choke 102 operates as an RF short circuit at a distal end of the first planar conductor 116 when an effective distance is the specified wavelength and operates as an RF open circuit at a distal end of the second planar conductor 118 for DC signals. In at least one embodiment, the RF choke 102 operates as an insulator at DC levels and a connector at RF operating frequencies during operation.

In at least one embodiment, as illustrated in FIG. 1, the RF choke 102 includes grounding pads 120 on the first surface of the circuit board 106 and grounding pads 122 on the second surface of the circuit board 106. Grounding pads 120, 122 can be electrically coupled together using one or more vias 124. The grounding pads 120, 122 can be electrically coupled to the second planar conductor 118. This can allow the circuit board 106 to be physically secured to the chassis 108 while ensuring good electrical connections between the grounding pads 122, which are coupled to the second planar conductor 118 of the RF choke 102.

In at least one embodiment, the circuit board 106 is coupled to a chassis of another structure of another system, such as a space vehicle, a vehicle, a boat, a building, a dwelling, or the like, where the chassis or other physical structure is electrically grounded at a first ground potential and the circuit board 106 is electrically grounded at a second ground potential. An RF structure, similar to the RF choke 102 described above, can include a first conductor electrically coupled to a ground plane of the circuit board 106 and a second conductor electrically coupled to the chassis. A physical arrangement of a portion of the first conductor and a portion of the second conductor causes the RF structure to provide an electrically insulating gap between the ground plane and the chassis at DC and an electrical connection between the ground plane and the chassis at RF operating frequencies. As described herein, the structure can be part of a satellite or other structures as described herein.

Referring back to FIG. 1, in at least one embodiment, the first planar conductor 116 includes a first circular perimeter and the second planar conductor 118 includes a second circular perimeter. As such, the portion of the first planar conductor 116 and the portion of the second planar conductor 118 that overlap horizontally form an overlapping region having a disk shape, such as illustrated in FIG. 2.

Figure 2:
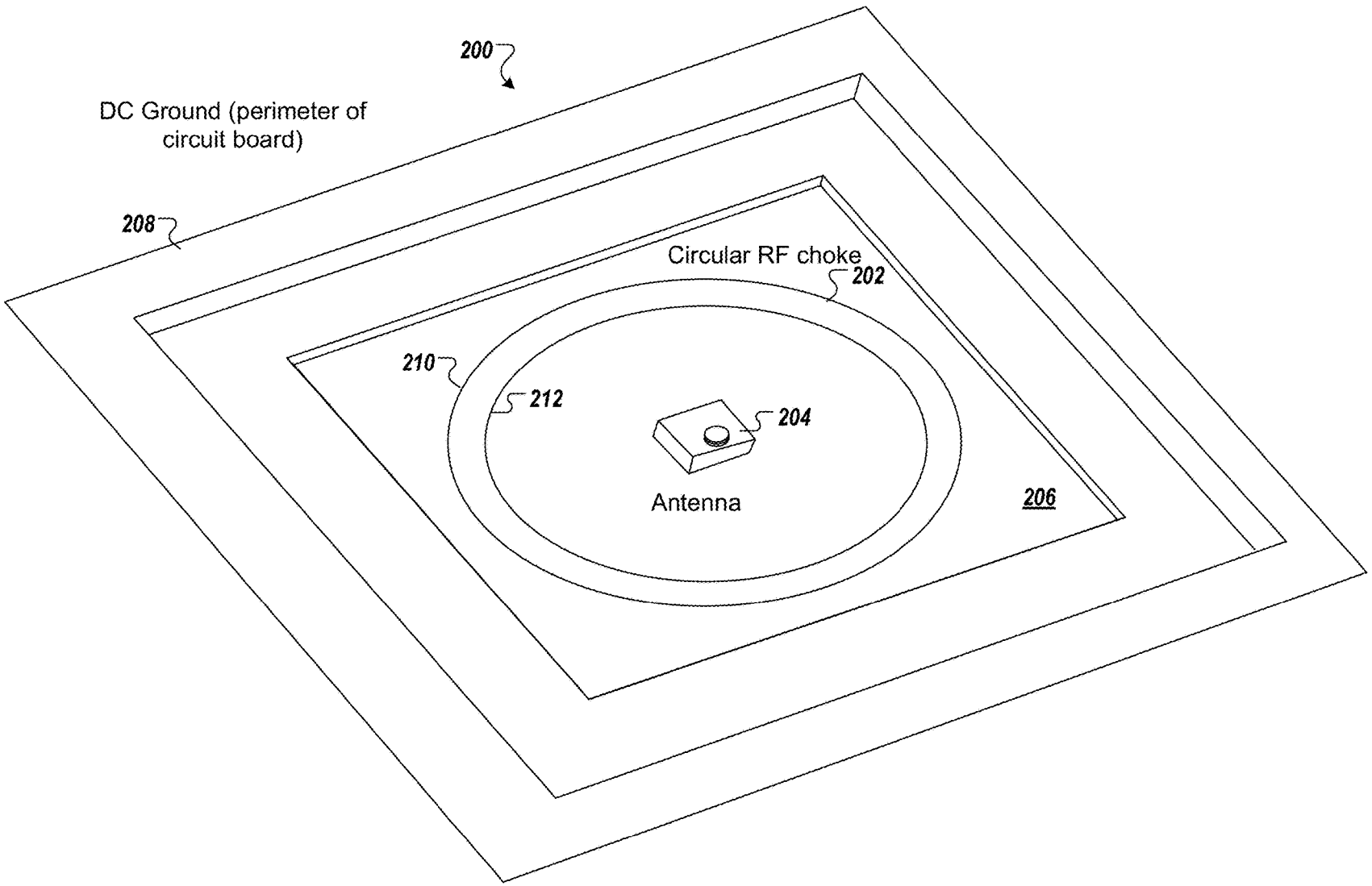
FIG. 2 is a perspective view of an antenna module with an RF choke according to at least one embodiment.

FIG. 2 is a perspective view of an antenna module 200 with a circular RF choke 202 according to at least one embodiment. The antenna module 200 includes a circuit board 206 that is physically and electrically coupled to a chassis 208. The chassis 208 is electrically grounded at a first ground potential, whereas a ground plane of the circuit board 206 is electrically grounded at a second ground potential. The antenna module 200 includes an antenna element 204 that is located on a first side of the circuit board 206. In at least one embodiment, the circuit board 206 is physically coupled to the chassis 208 at a perimeter of the circuit board 106. The antenna module 200 also includes a circular RF choke 202 that is implemented in the circuit board 206. In at least one embodiment, the circular RF choke 202 is formed with a first conductor electrically coupled to the ground plane and a second conductor electrically coupled to the chassis 208. In at least one embodiment, the first conductor is a first planar conductor located in a first layer of the circuit board 206 and the second conductor is a second planar conductor located in a second layer of the circuit board 206. The first planar conductor can be electrically coupled to the ground plane and the second planar conductor is electrically coupled to the first ground potential of the chassis 208. A portion of the first planar conductor and a portion of the second planar conductor overlap horizontally by an effective distance of a specified wavelength (e.g., a quarter wavelength, three-quarter wavelength, or the like). During operation, the circular RF choke 202 provides i) an electrically insulating gap between the ground plane and the chassis 208 at DC and ii) an electrical connection between the ground plane and the chassis 208 at RF operating frequencies of an integrated circuit that is coupled to the antenna element 204.

In at least one embodiment, the circular RF choke 202 operates as an RF short circuit at a distal end of the first planar conductor when an effective distance is the specified wavelength and operates as an open circuit at a distal end of the second planar conductor for DC signals. In at least one embodiment, the circular RF choke 202 operates as an insulator at DC levels and a connector at RF operating frequencies during operation.

As illustrated in FIG. 2, the first conductor has an outer edge 210 with a circular shape and the second conductor has an outer edge 212 with a circular shape. In at least one embodiment, a portion of the first conductor and a portion of the second conductor overlap horizontally by an effective distance that is a quarter wavelength of an operating frequency of the antenna element 204. In at least one embodiment, a portion of the first conductor and a portion of the second conductor overlap horizontally by an effective distance that is a three-quarter wavelength of an operating frequency of the antenna element 204. In at least one embodiment, the portion of the first planar conductor and the portion of the second planar conductor that overlap horizontally forms an overlapping region having a disk shape, as illustrated in FIG. 2. Alternatively, the first conductor is a planar conductor that has a rectangular or square perimeter and the second conductor is a planar conductor that has a rectangular or square perimeter. The portion of the first planar conductor and the portion of the second planar conductor form an overlapping region having a rectangular shape.

As described herein, the circuit board can include one or more grounding structures located at a side of the circuit board, such as at a perimeter or edge of the circuit board 206. The one or more grounding structures are physically coupled and electrically coupled to one or more corresponding DC grounding point on chassis 208. For example, a grounding structure can include a first electrode, a second electrode, and a set of one or more vias coupled between the first electrode and the second electrode. The first electrode is located on a first surface of the circuit board 206 (e.g., near a third side), the first surface being on the second side of the circuit board. The second electrode is located on a second surface of the circuit board near the third side, the second surface being on the first side of the circuit board. In at least one embodiment, the first conductor is a first planar conductor that is located in a first layer of the circuit board and the second conductor is a second planar conductor that is located in a second layer of the circuit board and coupled to the set of vias. In another embodiment, the circuit board includes a first grounding structure located at a third side of the circuit board and a second grounding structure located at a fourth side of the circuit board. The first grounding structure is physically coupled and electrically coupled to a first DC grounding point on the chassis and the second grounding structure is physically coupled and electrically coupled to a second DC grounding point on the chassis. The second conductor is electrically coupled to the first grounding structure and the second grounding structure.

In at least one embodiment, the first conductor is a first planar conductor that is located in a first layer of the circuit board 206 and coupled to a set of one or more vias, the set of one or more vias being coupled to the ground plane. The second conductor is a second planar conductor that is located in a second layer of the circuit board and coupled to the set of vias.

In another embodiment, the circuit board includes a first set of vias coupled to the antenna element 204, a second set of one or more vias coupled to the first conductor and the ground plane, and a third set of one or more vias coupled to the second conductor and the chassis 208.

Figure 3A:
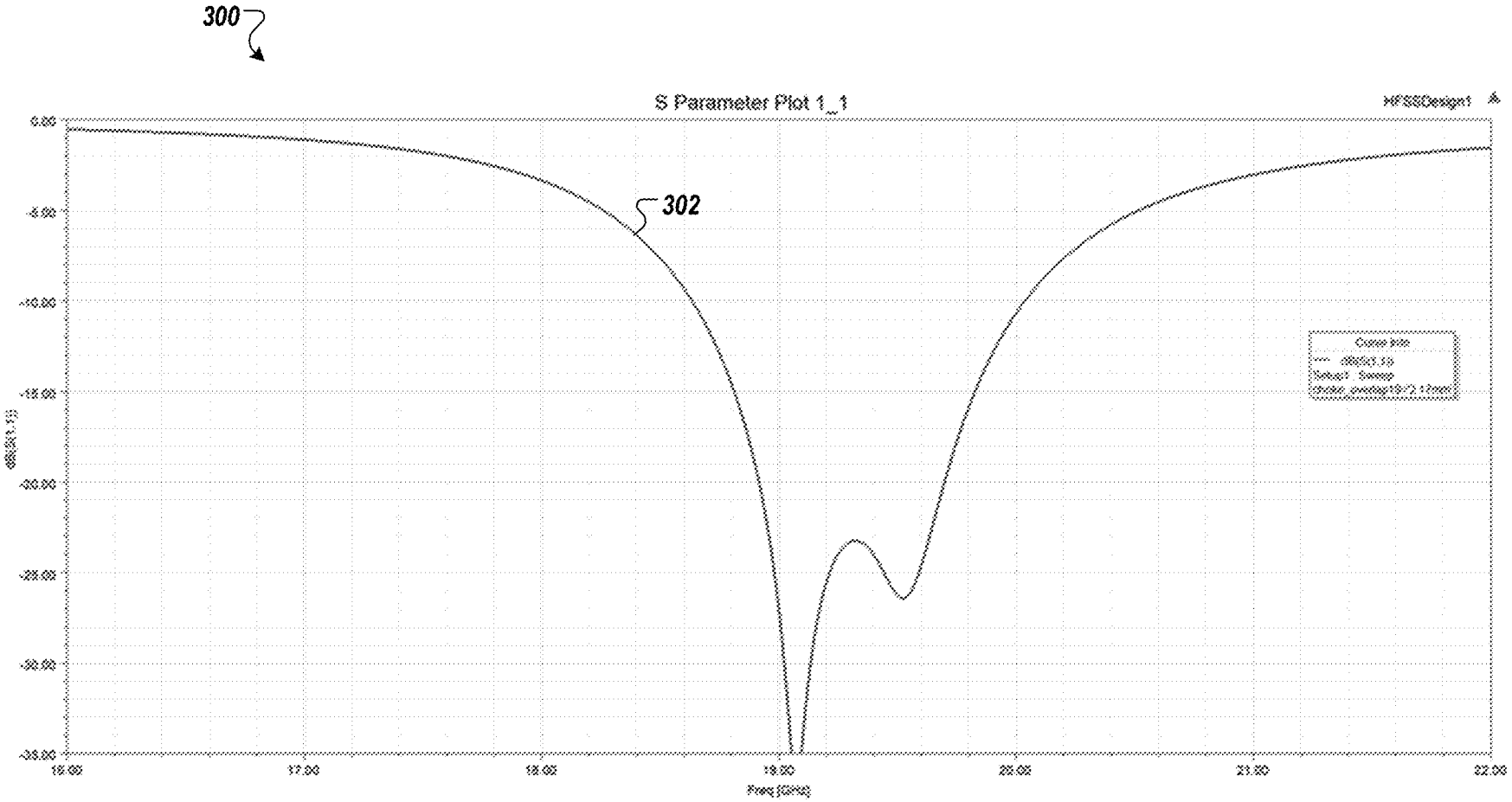
FIG. 3A is a graph of an antenna impedance match of an antenna module with an RF choke according to at least one embodiment.

FIG. 3A is a graph 300 of an antenna impedance match 302 of an antenna module with an RF choke according to at least one embodiment. The antenna impedance match 302 is shown as the return loss of the antenna structure, which can be represented as the S-parameter or reflection coefficient or $S_{11}$ of the antenna structure, including the effects caused by the ground plane and the RF choke. As shown in FIG. 3A, the return loss is less than −5.0 dB from approximately 18.4 GHz to approximately 20.5 GHz. FIG. 3 shows good antenna performance at the 19 GHz frequency band. Graph 300 shows no undesired resonances or bandwidth degradation, as compared to when there is a physical gap between the circuit board and the chassis, such as illustrated in FIG. 3B.

Figure 3B:
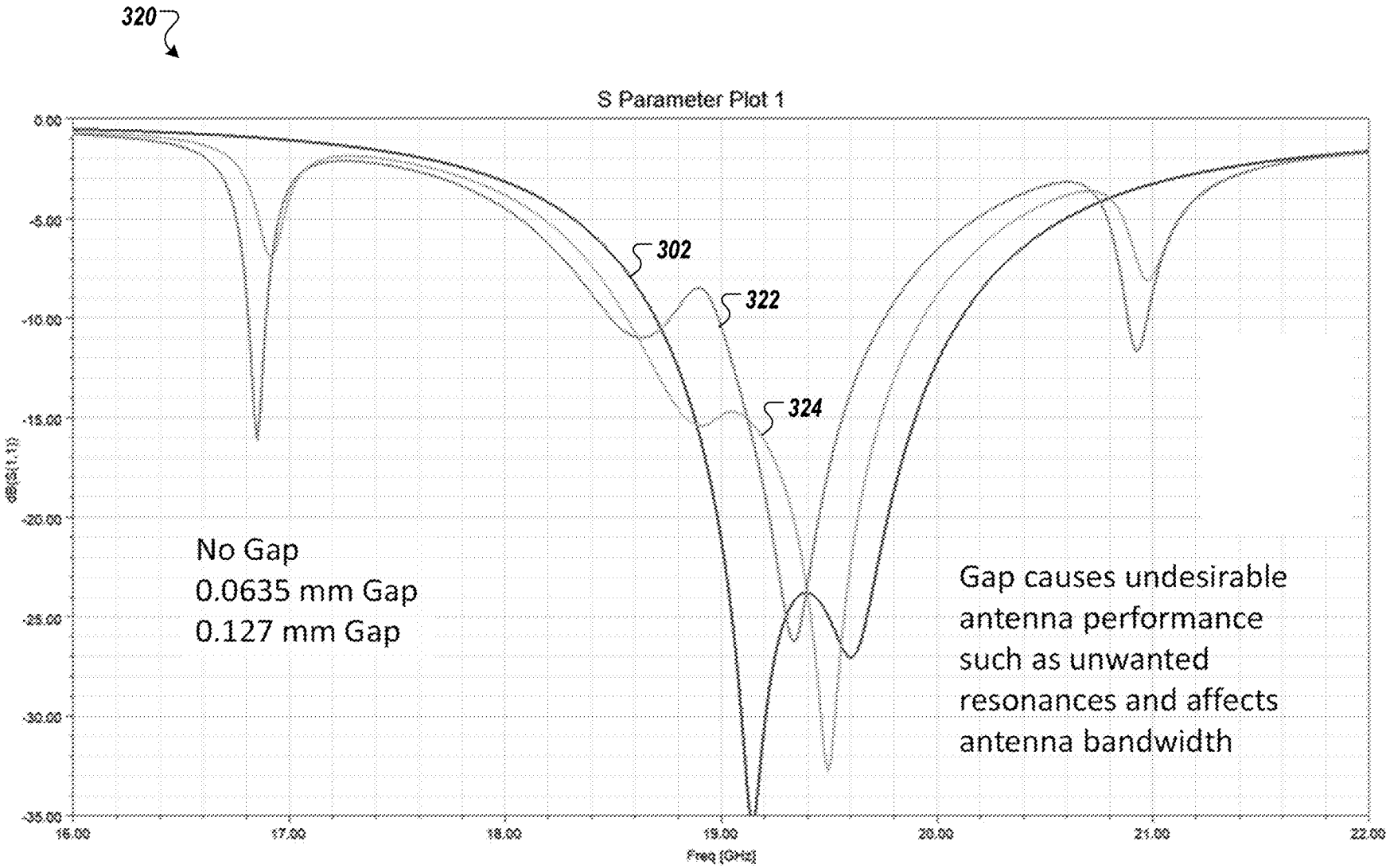
FIG. 3B is a graph illustrating a comparison of antenna impedance match of an antenna module with an RF choke, an antenna module with a first-sized physical gap, and an antenna module with a second-sized physical gap according to at least one embodiment.

FIG. 3B is a graph 320 illustrating a comparison of antenna impedance match 302 of an antenna module with an RF choke, an antenna module with a first-sized physical gap 322, and an antenna module with a second-sized physical gap 324 according to at least one embodiment. Graph 320 shows that the antenna module with the first-sized physical gap 232 (e.g., 0.0635 mm) has undesired resonances and bandwidth degradation. Graph 320 also shows that the antenna module with the second-sized physical gap 234 (e.g., 0.127) has undesired resonances and bandwidth degradation. In contrast, the antenna impedance match 302 of an antenna module with an RF choke does not have undesired resonances and bandwidth degradation.

Figure 3C:
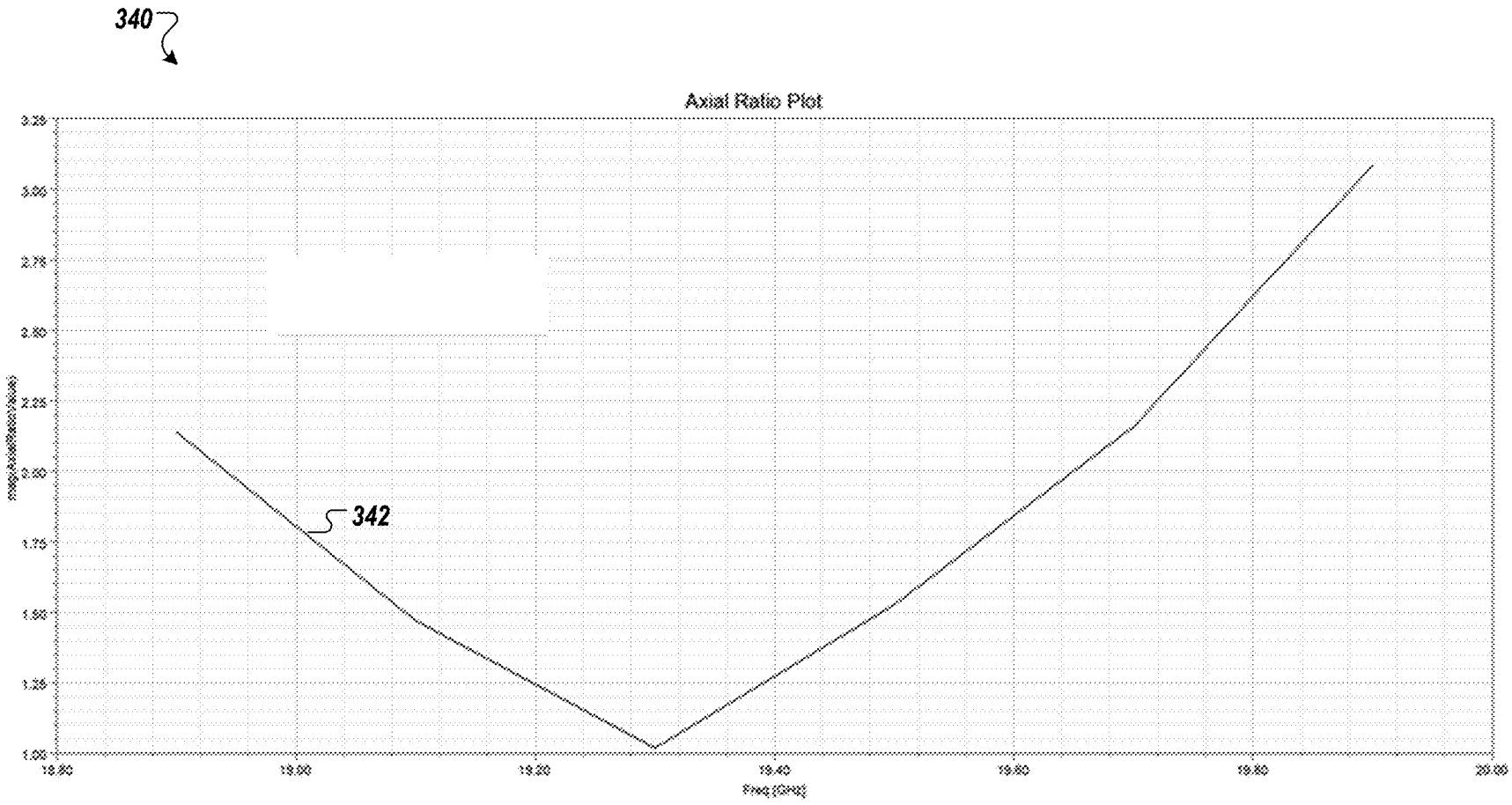
FIG. 3C is a graph of an antenna polarization performance of an antenna module with an RF choke according to at least one embodiment.

FIG. 3C is a graph 340 of an antenna polarization performance 342 of an antenna module with an RF choke according to at least one embodiment. Graph 340 is an axial ratio plot that shows good polarization performance using the RF choke. Graph 340 shows no polarization degradation, as compared to when there is a physical gap between the circuit board and the chassis, such as illustrated in FIG. 3D.

Figure 3D:
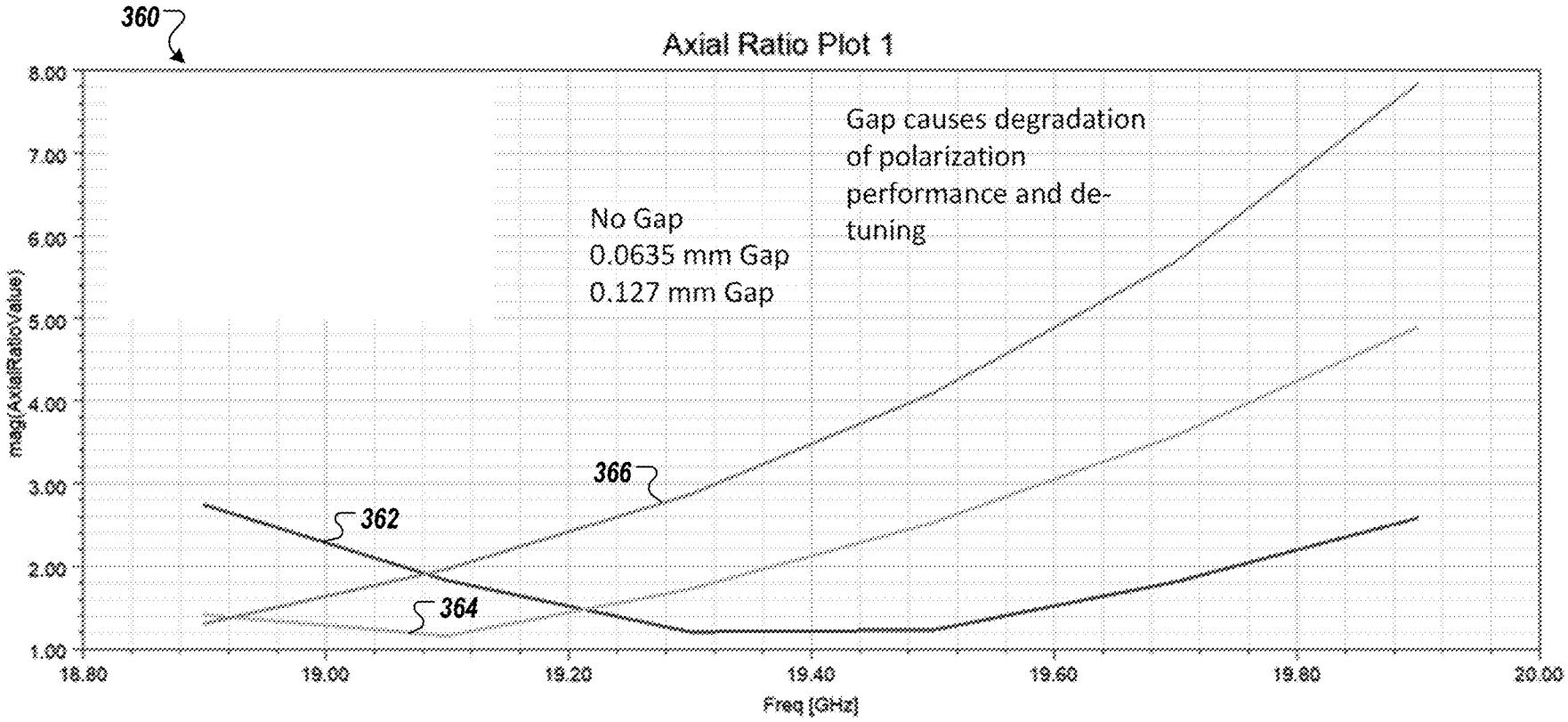
FIG. 3D is a graph illustrating a comparison of antenna polarization performance of an antenna module with an RF choke, an antenna module with a first-sized physical gap, and an antenna module with a second-sized physical gap according to at least one embodiment.

FIG. 3D is a graph 360 illustrating a comparison of antenna polarization performance 362 of an antenna module with an RF choke, an antenna module with a first-sized physical gap 364, and an antenna module with a second-sized physical gap 366 according to at least one embodiment. Graph 360 shows that the first-sized physical gap 364 (e.g., 0.0635 mm) causes degradation in polarization performance and detuning. Graph 360 also shows that the second-sized physical gap 234 (e.g., 0.127) causes degradation in polarization performance and detuning. In contrast, the antenna polarization performance 362 of an antenna module with an RF choke does not have degradation in polarization performance and detuning.

Figures 4A, 4B:
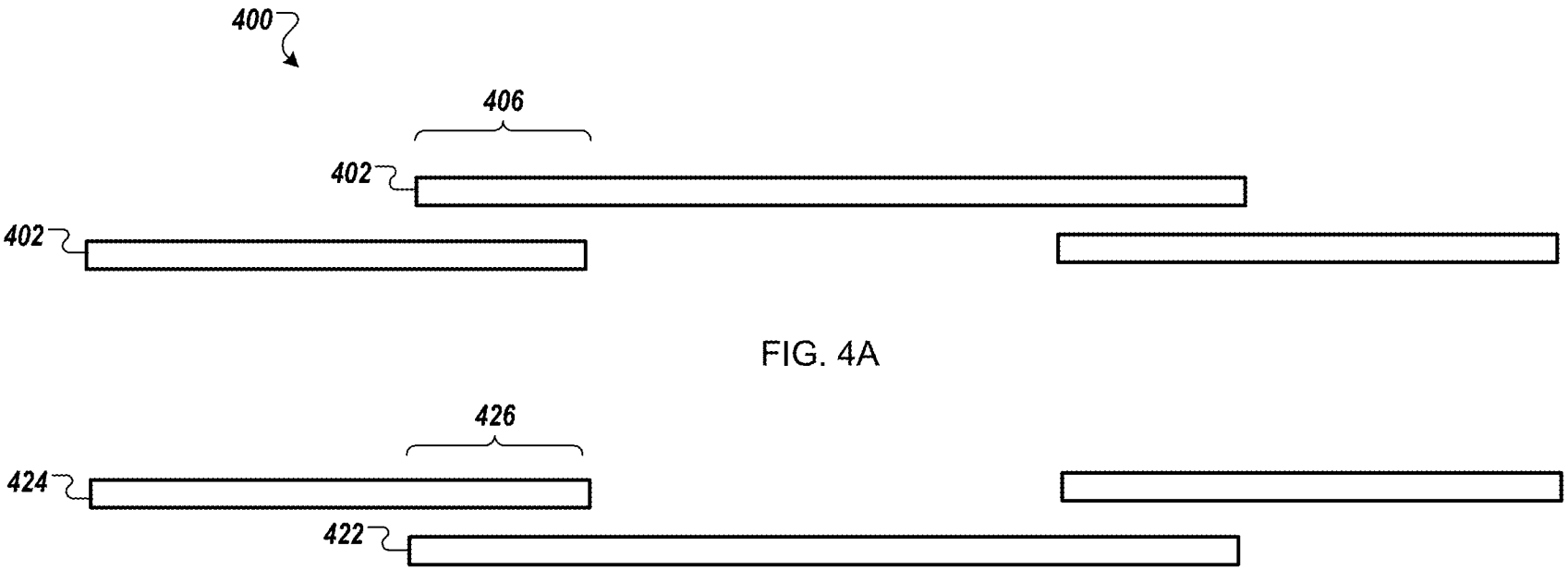
FIG. 4A is a cross-sectional view of an RF choke according to at least one embodiment.
FIG. 4B is a cross-sectional view of an RF choke according to at least one embodiment.

FIG. 4A is a cross-sectional view of an RF choke 400 according to at least one embodiment. RF choke 400 is a quarter-wave RF choke that is implemented in multiple layers of a circuit board. RF choke 400 includes a first planar conductor 402 located in a first layer of the circuit board and a second planar conductor 404 located in a second layer that is below the first layer. The first planar conductor 402 is electrically coupled to a ground plane associated with the circuit board and the second planar conductor 404 is electrically coupled to a ground of a chassis. A portion of the first planar conductor 402 and a portion of the second planar conductor 404 overlap horizontally by an effective distance 406 of a quarter wavelength. In other embodiments, the first planar conductor 402 and second planar conductor 404 can overlap by other effective distances, corresponding to odd multiples of the quarter wavelength, such as three-quarters wavelength, etc. During operation, the RF choke 400 provides i) an electrically insulating gap between the ground plane and the chassis at DC and ii) an electrical connection between the ground plane and the chassis at RF operating frequencies.

FIG. 4B is a cross-sectional view of an RF choke 420 according to at least one embodiment. RF choke 420 is a quarter-wave RF choke that is implemented in multiple layers of a circuit board. RF choke 420 includes a first planar conductor 422 located in a first layer of the circuit board and a second planar conductor 424 located in a second layer that is above the first layer. The first planar conductor 422 is electrically coupled to a ground plane associated with the circuit board and the second planar conductor 424 is electrically coupled to a ground of a chassis. A portion of the first planar conductor 422 and a portion of the second planar conductor 424 overlap horizontally by an effective distance 426 of a quarter wavelength. In other embodiments, the first planar conductor 422 and second planar conductor 424 can overlap by other effective distances, corresponding to odd multiples of the quarter wavelength, such as three-quarters wavelength, etc. During operation, the RF choke 420 provides i) an electrically insulating gap between the ground plane and the chassis at DC and ii) an electrical connection between the ground plane and the chassis at RF operating frequencies.

Figure 5:
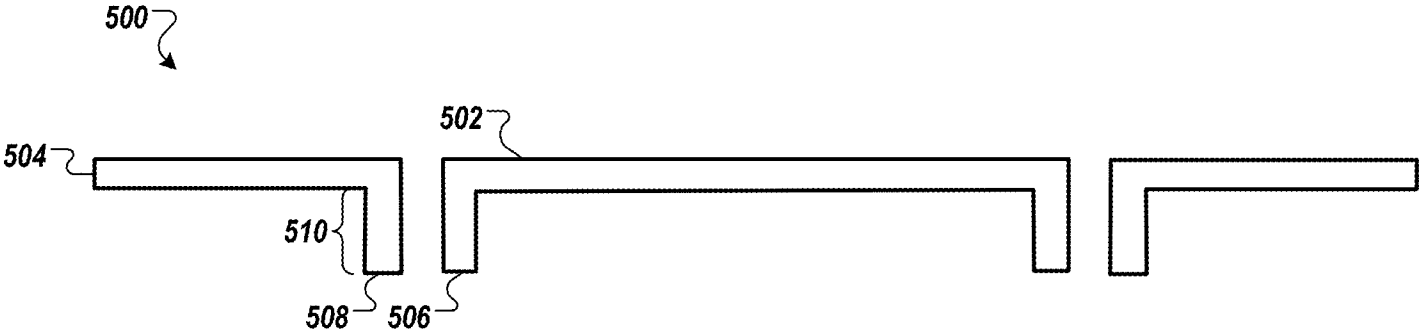
FIG. 5 is a cross-sectional view of an RF choke according to at least one embodiment.

FIG. 5 is a cross-sectional view of an RF choke 500 according to at least one embodiment. RF choke 500 is a quarter-wave RF choke that is implemented in multiple layers of a circuit board. RF choke 500 includes a first conductor 502 located in a first area of the circuit board and a second conductor 504 located in a second area that is adjacent to the first area. The first conductor 502 is electrically coupled to a ground plane associated with the circuit board and the second conductor 504 is electrically coupled to a ground of a chassis. A portion 506 of the first conductor and a portion 508 of the second conductor 504 overlap vertically by an effective distance 510 of a quarter wavelength. In other embodiments, the first conductor 502 and second conductor 504 can overlap by other effective distances, corresponding to odd multiples of the quarter wavelength, such as three-quarters wavelength, etc. During operation, the RF choke 500 provides i) an electrically insulating gap between the ground plane and the chassis at DC and ii) an electrical connection between the ground plane and the chassis at RF operating frequencies.

Figure 6:
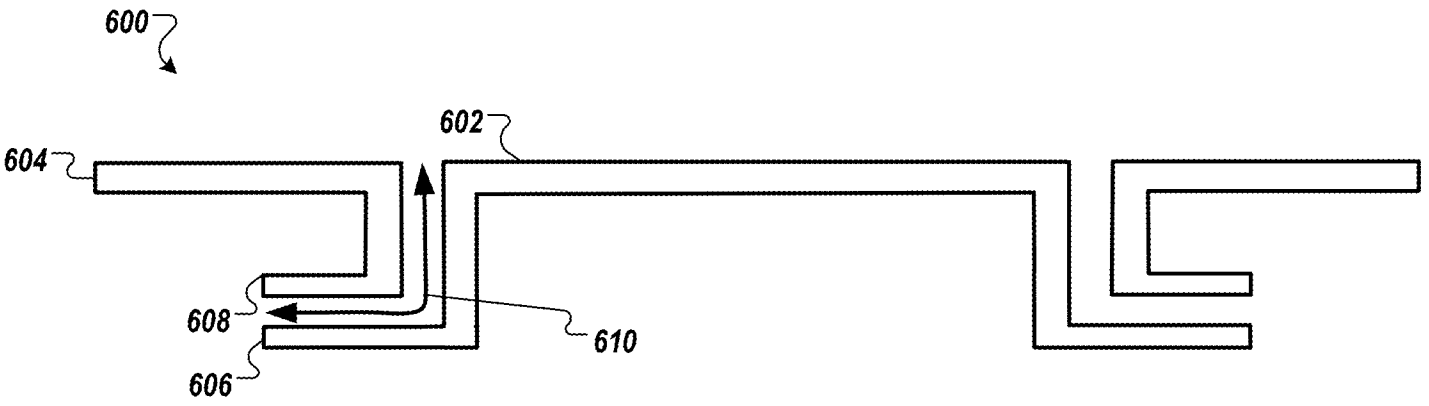
FIG. 6 is a cross-sectional view of an RF choke according to at least one embodiment.

FIG. 6 is a cross-sectional view of an RF choke 600 according to at least one embodiment. RF choke 600 is a quarter-wave RF choke that is implemented in multiple layers of a circuit board. RF choke 600 includes a first conductor 602 located in a first area of the circuit board and a second conductor 604 located in a second area that is adjacent to the first area. The first conductor 602 is electrically coupled to a ground plane associated with the circuit board and the second conductor 604 is electrically coupled to a ground of a chassis. A portion 606 of the first conductor and a portion 608 of the second conductor 604 overlap vertically and horizontally by an effective distance 610 of a quarter wavelength. In other embodiments, the first conductor 602 and second conductor 604 can overlap by other effective distances, corresponding to odd multiples of the quarter wavelength, such as three-quarters wavelength, etc. During operation, the RF choke 600 provides i) an electrically insulating gap between the ground plane and the chassis at DC and ii) an electrical connection between the ground plane and the chassis at RF operating frequencies.

Figure 7:
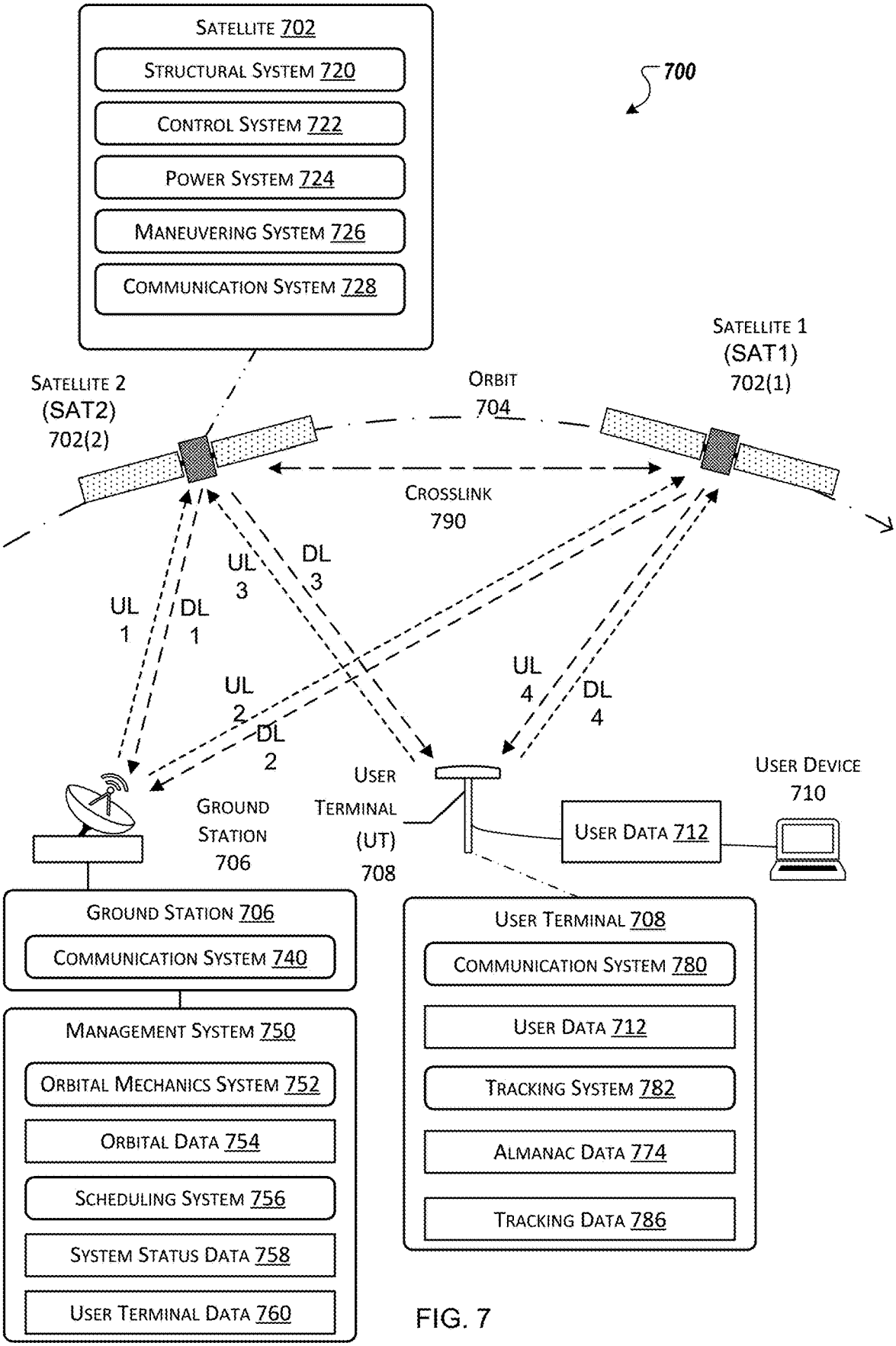
FIG. 7 illustrates a portion of a communication system that includes two satellites of a constellation of satellites, each satellite being in orbit, according to embodiments of the present disclosure.

FIG. 7 illustrates a portion of a communication system 700 that includes two satellites of a constellation of satellites 702(1), 702(2), . . . , 702(S), each satellite 702 being in orbit 704 according to embodiments of the present disclosure. The communication system 700 shown here comprises a plurality (or "constellation") of satellites 702(1), 702(2), . . . , 702(S), each satellite 702 being in orbit 704. Any of the satellites 702 can include the communication system that includes the antenna modules of FIGS. 1-6. Also shown is a ground station 706, user terminal (UT) 708, and a user device 710.

The constellation may comprise hundreds or thousands of satellites 702, in various orbits 704. For example, one or more of these satellites 702 may be in non-geosynchronous orbits (NGOs) in which they are in constant motion with respect to the Earth. For example, orbit 704 is a low earth orbit (LEO). In this illustration, orbit 704 is depicted with an arc pointed to the right. A first satellite (SAT1) 702(1) is leading (ahead of) a second satellite (SAT2) 702(2) in the orbit 704.

Satellite 702 may comprise a structural system 720, a control system 722, a power system 724, a maneuvering system 726, and a communication system 728 described herein. In other implementations, some systems may be omitted or other systems added. One or more of these systems may be communicatively coupled with one another in various combinations.

The structural system 720 comprises one or more structural elements to support the operation of satellite 702. For example, the structural system 720 may include trusses, struts, panels, and so forth. The components of other systems may be affixed to, or housed by, the structural system 720. For example, the structural system 720 may provide mechanical mounting and support for solar panels in the power system 724. The structural system 720 may also provide for thermal control to maintain components of the satellite 702 within operational temperature ranges. For example, the structural system 720 may include louvers, heat sinks, radiators, and so forth.

The control system 722 provides various services, such as operating the onboard systems, resource management, providing telemetry, processing commands, and so forth. For example, the control system 722 may direct the operation of the communication system 728.

The power system 724 provides electrical power for the operation of the components onboard satellite 702. The power system 724 may include components to generate electrical energy. For example, the power system 724 may comprise one or more photovoltaic cells, thermoelectric devices, fuel cells, and so forth. The power system 724 may include components to store electrical energy. For example, the power system 724 may comprise one or more batteries, fuel cells, and so forth.

The maneuvering system 726 maintains the satellite 702 in one or more of a specified orientation or orbit 704. For example, the maneuvering system 726 may stabilize satellite 702 with respect to one or more axis. In another example, the maneuvering system 726 may move the satellite 702 to a specified orbit 704. The maneuvering system 726 may include one or more computing devices, sensors, thrusters, momentum wheels, solar sails, drag devices, and so forth. For example, the sensors of the maneuvering system 726 may include one or more global navigation satellite system (GNSS) receivers, such as global positioning system (GPS) receivers, to provide information about the position and orientation of satellite 702 relative to Earth. In another example, the sensors of the maneuvering system 726 may include one or more star trackers, horizon detectors, and so forth. The thrusters may include, but are not limited to, cold gas thrusters, hypergolic thrusters, solid-fuel thrusters, ion thrusters, arcjet thrusters, electrothermal thrusters, and so forth.

The communication system 728 provides communication with one or more other devices, such as other satellites 702, ground stations 706, user terminals 708, and so forth. The communication system 728 may include one or more modems, digital signal processors, power amplifiers, antennas (including at least one antenna that implements multiple antenna elements, such as a phased array antenna, and including an embedded calibration antenna, such as the calibration antenna 704 as described herein), processors, memories, storage devices, communications peripherals, interface buses, and so forth. Such components support communications with other satellites 702, ground stations 706, user terminals 708, and so forth using radio frequencies within a desired frequency spectrum. The communications may involve multiplexing, encoding, and compressing data to be transmitted, modulating the data to a desired radio frequency, and amplifying it for transmission. The communications may also involve demodulating received signals and performing any necessary de-multiplexing, decoding, decompressing, error correction, and formatting of the signals. Data decoded by the communication system 728 may be output to other systems, such as to the control system 722, for further processing. Output from a system, such as the control system 722, may be provided to the communication system 728 for transmission.

One or more ground stations 706 are in communication with one or more satellites 702. The ground stations 706 may pass data between the satellites 702, a management system 750, networks such as the Internet, and so forth. The ground stations 706 may be emplaced on land, on vehicles, at sea, and so forth. Each ground station 706 may comprise a communication system 740. Each ground station 706 may use the communication system 740 to establish communication with one or more satellites 702, other ground stations 706, and so forth. The ground station 706 may also be connected to one or more communication networks. For example, the ground station 706 may connect to a terrestrial fiber optic communication network. The ground station 706 may act as a network gateway, passing user data 712 or other data between the one or more communication networks and the satellites 702. Such data may be processed by the ground station 706 and communicated via the communication system 740. The communication system 740 of a ground station may include components similar to those of the communication system 728 of a satellite 702 and may perform similar communication functionalities. For example, the communication system 740 may include one or more modems, digital signal processors, power amplifiers, antennas (including at least one antenna that implements multiple antenna elements, such as a phased array antenna), processors, memories, storage devices, communications peripherals, interface buses, and so forth.

The ground stations 706 are in communication with a management system 750. The management system 750 is also in communication, via the ground stations 706, with the satellites 702 and the UTs 708. The management system 750 coordinates the operation of the satellites 702, ground stations 706, UTs 708, and other resources of the communication system 700. The management system 750 may comprise one or more of an orbital mechanics system 752 or a scheduling system 756. In some embodiments, the scheduling system 756 can operate in conjunction with an HD controller.

The orbital mechanics system 752 determines orbital data 754 that is indicative of a state of a particular satellite 702 at a specified time. In one implementation, the orbital mechanics system 752 may use orbital elements that represent characteristics of the orbit 704 of the satellites 702 in the constellation to determine the orbital data 754 that predicts location, velocity, and so forth of particular satellites 702 at particular times or time intervals. For example, the orbital mechanics system 752 may use data obtained from actual observations from tracking stations, data from the satellites 702, scheduled maneuvers, and so forth to determine the orbital elements. The orbital mechanics system 752 may also consider other data, such as space weather, collision mitigation, orbital elements of known debris, and so forth.

The scheduling system 756 schedules resources to provide communication to the UTs 708. For example, the scheduling system 756 may determine handover data that indicates when communication is to be transferred from the first satellite 702(1) to the second satellite 702(2). Continuing the example, the scheduling system 756 may also specify communication parameters such as frequency, timeslot, and so forth. During operation, the scheduling system 756 may use information such as the orbital data 754, system status data 758, user terminal data 760, and so forth.

The system status data 758 may comprise information such as which UTs 708 are currently transferring data, satellite availability, current satellites 702 in use by respective UTs 708, capacity available at particular ground stations 706, and so forth. For example, the satellite availability may comprise information indicative of satellites 702 that are available to provide communication service or those satellites 702 that are unavailable for communication service. Continuing the example, a satellite 702 may be unavailable due to malfunction, previous tasking, maneuvering, and so forth. The system status data 758 may be indicative of past status, predictions of future status, and so forth. For example, the system status data 758 may include information such as projected data traffic for a specified interval of time based on previous transfers of user data 712. In another example, the system status data 758 may be indicative of future status, such as a satellite 702 being unavailable to provide communication service due to scheduled maneuvering, scheduled maintenance, scheduled decommissioning, and so forth.

The user terminal data 760 may comprise information such as a location of a particular UT 708. The user terminal data 760 may also include other information such as a priority assigned to user data 712 associated with that UT 708, information about the communication capabilities of that particular UT 708, and so forth. For example, a particular UT 708 in use by a business may be assigned a higher priority relative to a UT 708 operated in a residential setting. Over time, different versions of UTs 708 may be deployed, having different communication capabilities such as being able to operate at particular frequencies, supporting different signal encoding schemes, having different antenna configurations, and so forth.

The UT 708 includes a communication system 780 to establish communication with one or more satellites 702. The communication system 780 of the UT 708 may include components similar to those of the communication system 728 of a satellite 702 and may perform similar communication functionalities. For example, the communication system 780 may include one or more modems, digital signal processors, power amplifiers, antennas (including at least one antenna that implements multiple antenna elements, such as a phased array antenna), processors, memories, storage devices, communications peripherals, interface buses, and so forth. The UT 708 passes user data 712 between the constellation of satellites 702 and the user device 710. The user data 712 includes data originated by the user device 710 or addressed to the user device 710. The UT 708 may be fixed or in motion. For example, the UT 708 may be used at a residence, or on a vehicle such as a car, boat, aerostat, drone, airplane, and so forth.

The UT 708 includes a tracking system 782. The tracking system 782 uses almanac data 784 to determine tracking data 786. The almanac data 784 provides information indicative of orbital elements of the orbit 704 of one or more satellites 702. For example, the almanac data 784 may comprise orbital elements such as "two-line element" data for the satellites 702 in the constellation that are broadcast or otherwise sent to the UTs 708 using the communication system 780.

The tracking system 782 may use the current location of the UT 708 and the almanac data 784 to determine the tracking data 786 for satellite 702. For example, based on the current location of the UT 708 and the predicted position and movement of the satellites 702, the tracking system 782 is able to calculate the tracking data 786. The tracking data 786 may include information indicative of azimuth, elevation, distance to the second satellite, time of flight correction, or other information at a specified time. The determination of the tracking data 786 may be ongoing. For example, the first UT 708 may determine tracking data 786 every 700 ms, every second, every five seconds, or at other intervals.

With regard to FIG. 7, an uplink is a communication link which allows data to be sent to satellite 702 from a ground station 706, UT 708, or device other than another satellite 702. Uplinks are designated as UL1, UL2, UL3, and so forth. For example, UL1 is a first uplink from the ground station 706 to the second satellite 702(2). In comparison, a downlink is a communication link which allows data to be sent from satellite 702 to a ground station 706, UT 708, or device other than another satellite 702. For example, DL1 is a first downlink from the second satellite 702(2) to the ground station 706. The satellites 702 may also be in communication with one another. For example, a crosslink 790 provides for communication between satellites 702 in the constellation.

The satellite 702, the ground station 706, the user terminal 708, the user device 710, the management system 750, or other systems described herein may include one or more computing devices or computer systems comprising one or more hardware processors, computer-readable storage media, and so forth. For example, the hardware processors may include application-specific integrated circuits (ASICs), field-programmable gate arrays (FPGAs), microcontrollers, digital signal processors (DSPs), and so forth. The computer-readable storage media can include system memory, which may correspond to any combination of volatile and/or non-volatile memory or storage technologies. The system memory can store information that provides an operating system, various program modules, program data, and/or other software or firmware components. In one embodiment, the system memory stores instructions of methods to control the operation of the electronic device. The electronic device performs functions by using the processor(s) to execute instructions provided by the system memory. Embodiments may be provided as a software program or computer program including a non-transitory computer-readable storage medium having stored thereon instructions (in compressed or uncompressed form) that may be used to program a computer (or other electronic devices) to perform the processes or methods described herein. The computer-readable storage medium may be one or more of an electronic storage medium, a magnetic storage medium, an optical storage medium, a quantum storage medium, and so forth. For example, the computer-readable storage medium may include, but is not limited to, hard drives, floppy diskettes, optical disks, read-only memories (ROMs), random access memories (RAMs), erasable programmable ROMs (EPROMs), electrically erasable programmable ROMs (EEPROMs), flash memory, magnetic or optical cards, solid-state memory devices, or other types of physical media suitable for storing electronic instructions. Further embodiments may also be provided as a computer program product including a transitory machine-readable signal (in compressed or uncompressed form). Examples of transitory machine-readable signals, whether modulated using a carrier or unmodulated, include, but are not limited to, signals that a computer system or machine hosting or running a computer program can be configured to access, including signals transferred by one or more networks. For example, the transitory machine-readable signal may comprise transmission of software by the Internet.

Figure 8:
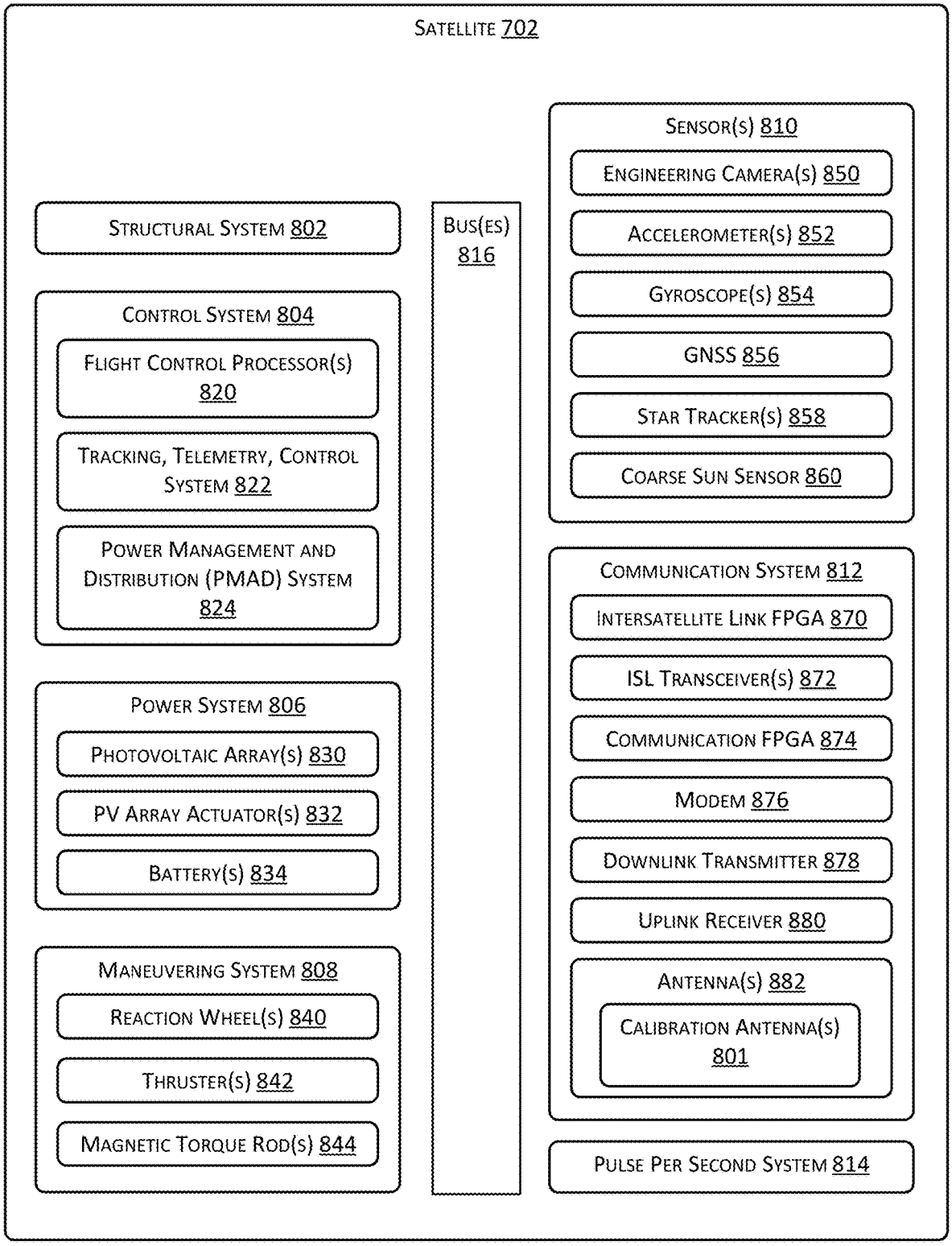
FIG. 8 is a functional block diagram of some systems associated with the satellite, according to some implementations.

FIG. 8 is a functional block diagram of some systems associated with satellite 702, according to some implementations. The satellite 702 may comprise a structural system 802, a control system 804, a power system 806, a maneuvering system 808, one or more sensors 810, and a communication system 812. A pulse per second (PPS) system 814 may be used to provide a timing reference to the systems onboard satellite 702. One or more busses 816 may be used to transfer data between the systems onboard satellite 702. In some implementations, redundant busses 816 may be provided. The busses 816 may include, but are not limited to, data busses such as Controller Area Network Flexible Data Rate (CAN FD), Ethernet, Serial Peripheral Interface (SPI), and so forth. In some implementations, the busses 816 may carry other signals. For example, a radio frequency bus may comprise coaxial cable, waveguides, and so forth to transfer radio signals from one part of the satellite 702 to another. In other implementations, some systems may be omitted or other systems added. One or more of these systems may be communicatively coupled with one another in various combinations.

The structural system 802 comprises one or more structural elements to support the operation of satellite 702. For example, the structural system 802 may include trusses, struts, panels, and so forth. The components of other systems may be affixed to, or housed by, the structural system 802. For example, the structural system 802 may provide mechanical mounting and support for solar panels in the power system 806. The structural system 802 may also provide for thermal control to maintain components of the satellite 702 within operational temperature ranges. For example, the structural system 802 may include louvers, heat sinks, radiators, and so forth.

The control system 804 provides various services, such as operating the onboard systems, resource management, providing telemetry, processing commands, and so forth. For example, the control system 804 may direct the operation of the communication system 812. The control system 804 may include one or more flight control processors 820. The flight control processors 820 may comprise one or more processors, FPGAs, and so forth. A tracking, telemetry, and control (TTC) system 822 may include one or more processors, radios, and so forth. For example, the TTC system 822 may comprise a dedicated radio transmitter and receiver to receive commands from a ground station 706, send telemetry to the ground station 706, and so forth. Power management and distribution (PMAD) system 824 may direct operation of the power system 806, control distribution of power to the systems of the satellite 702, control battery 834 charging, and so forth.

The power system 806 provides electrical power for the operation of the components onboard the satellite 702. The power system 806 may include components to generate electrical energy. For example, the power system 806 may comprise one or more photovoltaic arrays 830 comprising a plurality of photovoltaic cells, thermoelectric devices, fuel cells, and so forth. One or more PV array actuators 832 may be used to change the orientation of the photovoltaic array(s) 830 relative to the satellite 702. For example, the PV array actuator 832 may comprise a motor. The power system 806 may include components to store electrical energy. For example, the power system 806 may comprise one or more batteries 834, fuel cells, and so forth.

The maneuvering system 808 maintains the satellite 702 in one or more of a specified orientation or orbit 704. For example, the maneuvering system 808 may stabilize satellite 702 with respect to one or more axes. In another example, the maneuvering system 808 may move the satellite 702 to a specified orbit 704. The maneuvering system 808 may include one or more of reaction wheel(s) 840, thrusters 842, magnetic torque rods 844, solar sails, drag devices, and so forth. The thrusters 842 may include, but are not limited to, cold gas thrusters, hypergolic thrusters, solid-fuel thrusters, ion thrusters, arcjet thrusters, electrothermal thrusters, and so forth. During operation, the thrusters may expend propellant. For example, an electrothermal thruster may use water as propellant, using electrical power obtained from the power system 806 to expel the water and produce thrust. During operation, the maneuvering system 808 may use data obtained from one or more of the sensors 810.

Satellite 702 includes one or more sensors 810. The sensors 810 may include one or more engineering cameras 850. For example, an engineering camera 850 may be mounted on satellite 702 to provide images of at least a portion of the photovoltaic array 830. Accelerometers 852 provide information about the acceleration of satellite 702 along one or more axes. Gyroscopes 854 provide information about the rotation of satellite 702 with respect to one or more axes. The sensors 810 may include a global navigation satellite system (GNSS) 856 receiver, such as Global Positioning System (GPS) receiver, to provide information about the position of the satellite 702 relative to Earth. In some implementations, the GNSS 856 may also provide information indicative of velocity, orientation, and so forth. One or more star trackers 858 may be used to determine an orientation of satellite 702. A coarse sun sensor 860 may be used to detect the sun, provide information on the relative position of the sun with respect to satellite 702, and so forth. The satellite 702 may include other sensors 810 as well. For example, satellite 702 may include a horizon detector, radar, LIDAR, and so forth.

The communication system 812 provides communication with one or more other devices, such as other satellites 702, ground stations 706, user terminals 708, and so forth. The communication system 812 may include one or more modems 876, digital signal processors, power amplifiers, antennas 882 (including at least one antenna that implements multiple antenna elements, such as a phased array antenna such as the antenna elements 104 of FIG. 1), processors, memories, storage devices, communications peripherals, interface buses, and so forth. Such components support communications with other satellites 702, ground stations 706, user terminals 708, and so forth using radio frequencies within a desired frequency spectrum. The communications may involve multiplexing, encoding, and compressing data to be transmitted, modulating the data to a desired radio frequency, and amplifying it for transmission. The communications may also involve demodulating received signals and performing any necessary de-multiplexing, decoding, decompressing, error correction, and formatting of the signals. Data decoded by the communication system 812 may be output to other systems, such as to the control system 804, for further processing. Output from a system, such as the control system 804, may be provided to the communication system 812 for transmission.

The communication system 812 may include hardware to support the intersatellite link 790. For example, an intersatellite link FPGA 870 may be used to modulate data that is sent and received by an ISL transceiver 872 to send data between satellites 702. The ISL transceiver 872 may operate using radio frequencies, optical frequencies, and so forth.

A communication FPGA 874 may be used to facilitate communication between satellite 702 and the ground stations 706, UTs 708, and so forth. For example, the communication FPGA 874 may direct the operation of a modem 876 to modulate signals sent using a downlink transmitter 878 and demodulate signals received using an uplink receiver 880. The satellite 702 may include one or more antennas 882. For example, one or more parabolic antennas may be used to provide communication between satellite 702 and one or more ground stations 706. In another example, a phased array antenna may be used to provide communication between satellite 702 and the UTs 708.

Figure 9:
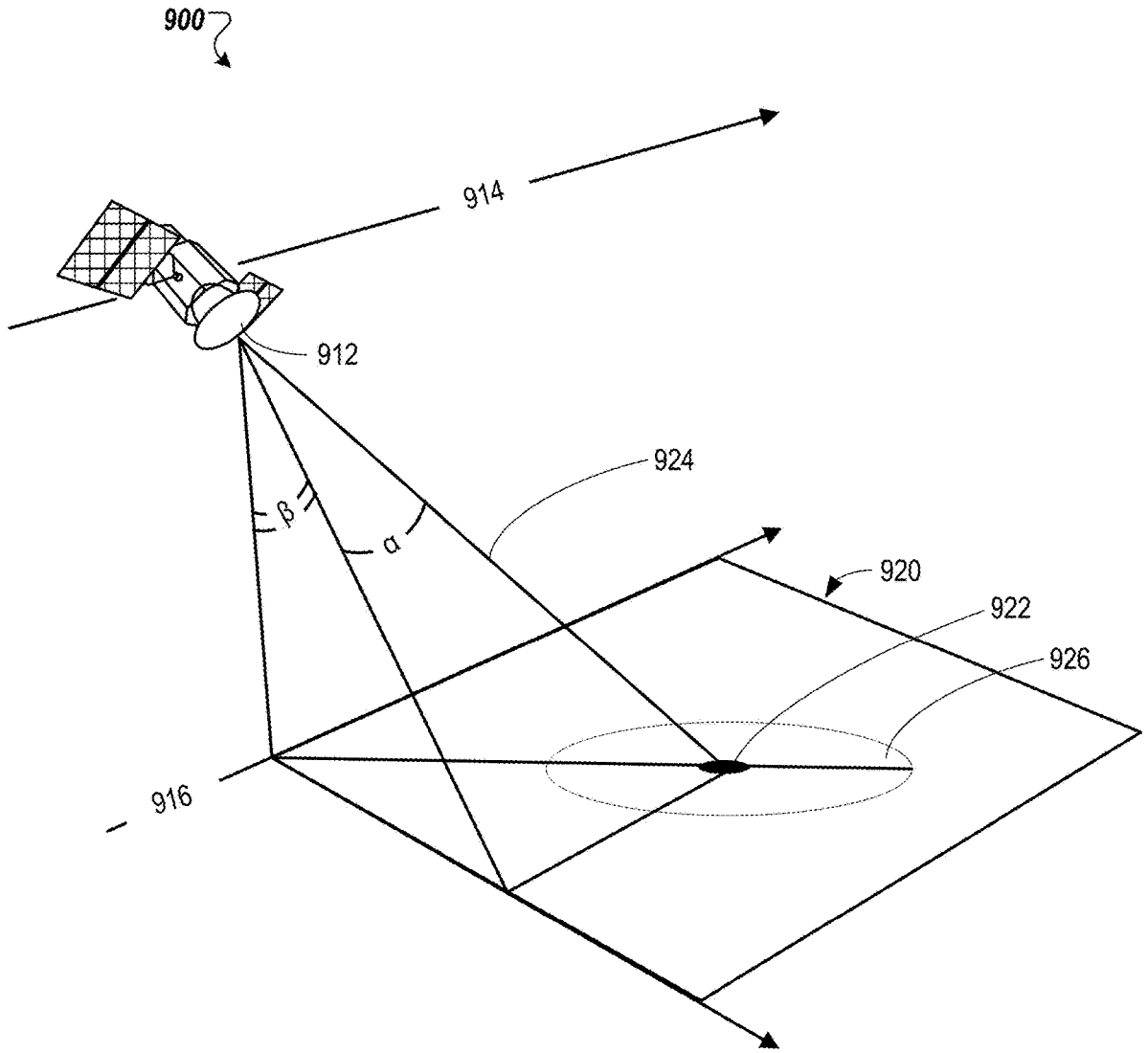
FIG. 9 illustrates a satellite including an antenna system that is steerable, according to embodiments of the present disclosure.

FIG. 9 illustrates the satellite 900 including an antenna system 912 that is steerable according to embodiments of the present disclosure. The satellite 900 can include the communication system with the antenna modules of FIGS. 1-6. The antenna system 912 may include multiple antenna elements that form an antenna and that can be mechanically or electrically steered individually, collectively, or a combination thereof. In an example, the antenna is a phased array antenna.

In orbit 704, the satellite 900 follows a path 914, the projection of which onto the surface of the Earth forms a ground path 916. In the example illustrated in FIG. 9, the ground path 916 and a projected axis extending orthogonally from the ground path 916 at the position of the satellite 900, together define a region 920 of the surface of the Earth. In this example, the satellite 900 is capable of establishing uplink and downlink communications with one or more of ground stations, user terminals, or other devices within region 920. In some embodiments, region 920 may be located in a different relative position to the ground path 916 and the position of the satellite 900. For example, region 920 may describe a region of the surface of the Earth directly below satellite 900. Furthermore, embodiments may include communications between the satellite 900, an airborne communications system, and so forth.

As shown in FIG. 9, a communication target 922 (e.g., a ground station, a user terminal, or a CT (such as an HD CT)) is located within region 920. The satellite 900 controls the antenna system 912 to steer transmission and reception of communications signals to selectively communicate with the communication target 922. For example, in a downlink transmission from satellite 900 to the communication target 922, a signal beam 924 emitted by the antenna system 912 is steerable within an area 926 of the region 920. In some implementations, the signal beam 924 may include multiple subbeams. The extents of the area 926 define an angular range within which the signal beam 924 is steerable, where the direction of the signal beam 924 is described by a beam angle "a" relative to a surface normal vector of the antenna system 912. In two-dimensional phased array antennas, the signal beam 924 is steerable in two dimensions, described in FIG. 9 by a second angle "β" orthogonal to the beam angle α. In this way, area 926 is a two-dimensional area within the region 920, rather than a linear track at a fixed angle determined by the orientation of the antenna system 912 relative to the ground path 916.

In FIG. 9, as the satellite 900 follows the path 914, the area 926 tracks along the surface of the Earth. In this way, the communication target 922, which is shown centered in the area 926 for clarity, is within the angular range of the antenna system 912 for a period of time. During that time, signals communicated between satellite 900 and the communication target 922 are subject to bandwidth constraints, including but not limited to signal strength and calibration of the signal beam 924. In an example, for phased array antenna systems, the signal beam 924 is generated by an array of mutually coupled antenna elements, wherein constructive and destructive interference produce a directional beam. Among other factors, phase drift, amplitude drift (e.g., of a transmitted signal in a transmitter array), and so forth affect the interference properties and thus the resultant directional beam or subbeam.

Figure 10:
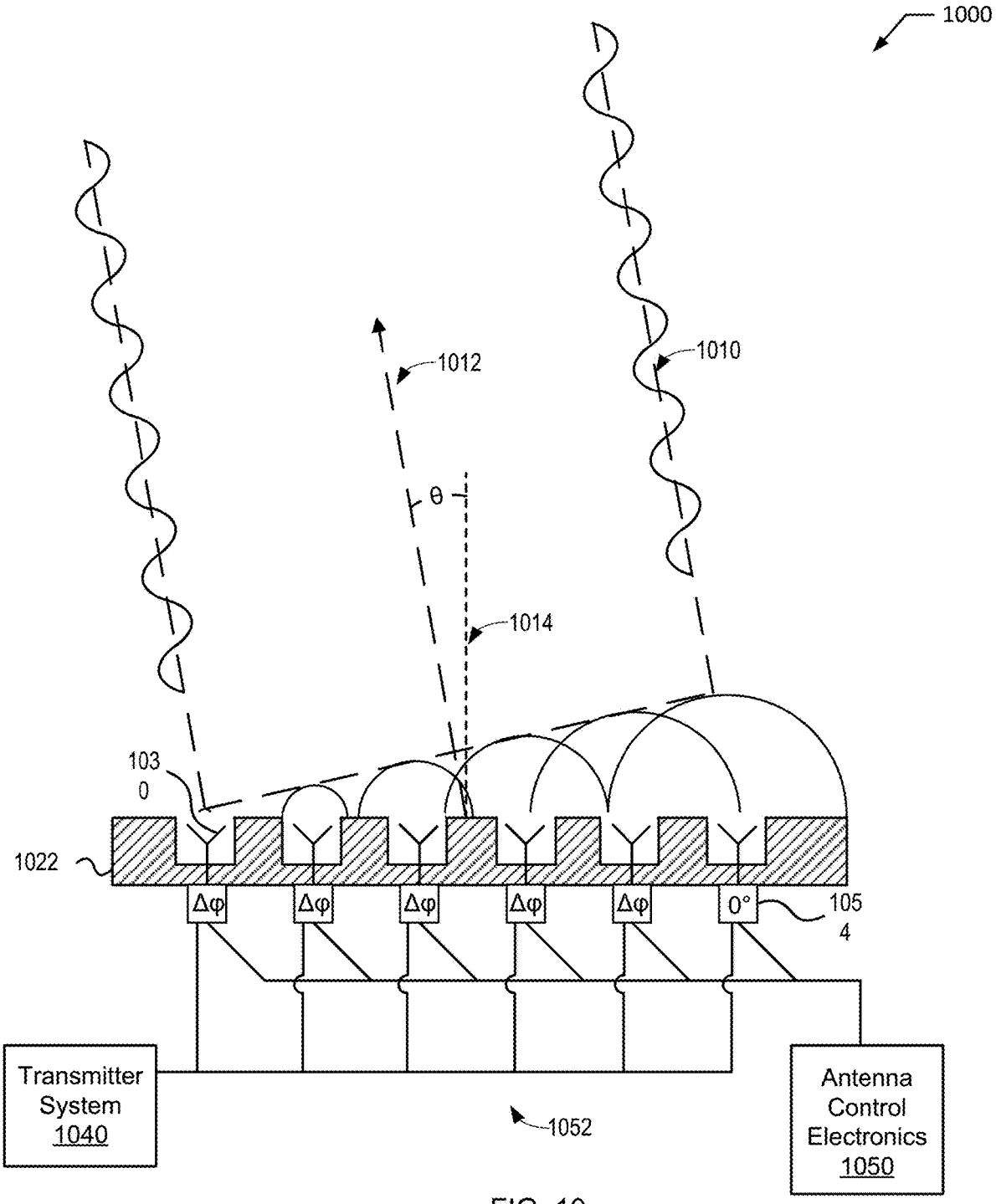
FIG. 10 illustrates a simplified schematic of an antenna, according to embodiments of the present disclosure.

FIG. 10 illustrates a simplified schematic of an antenna 1000, according to embodiments of the present disclosure. The antenna 1000 may be a component of the antenna system 912 of FIG. 9. As illustrated, the antenna 1000 is a phased array antenna that includes multiple antenna elements 1030 (e.g. antenna elements 104 in FIG. 1). Interference between the antenna elements 1030 forms a directional radiation pattern in both transmitter and receiver arrays forming a beam 1010 (beam extents shown as dashed lines). The beam 1010 is a portion of a larger transmission pattern (not shown) that extends beyond the immediate vicinity of the antenna 1000. The beam 1010 is directed along a beam vector 1012, described by an angle "0" relative to an axis 1014 normal to a surface of the antenna 1000. As described below, beam 1010 is one or more of steerable or shapeable through control of operating parameters including, but not limited to a phase and an amplitude of each antenna element 1030.

In FIG. 10, the antenna 1000 includes, within a transmitter section 1022, the antenna elements 1030, which may include but are not limited to, omnidirectional transmitter antennas coupled to a transmitter system 1040, such as the downlink transmitter 878. The transmitter system 1040 provides a signal, such as a downlink signal to be transmitted to a ground station on the surface. The downlink signal is provided to each antenna element 1030 as a time-varying signal that may include several multiplexed signals. To steer the beam 1010 relative to the axis 1014, the phased array antenna system includes antenna control electronics 1050 controlling a radio frequency (RF) feeding network 1052, including multiple signal conditioning components 1054 interposed between the antenna elements 1030 and the transmitter system 1040. The signal conditioning components 1054 introduce one or more of a phase modulation or an amplitude modulation (e.g. by phase shifters), as denoted by "$\Delta\varphi$" in FIG. 10, to the signal sent to the antenna elements 1030. As shown in FIG. 10, introducing a progressive phase modulation produces interference in the individual transmission of each antenna element 1030 that generates the beam 1010.

The phase modulation imposed on each antenna element 1030 can differ and can be dependent on a spatial location of a communication target that determines an optimum beam vector (e.g., where the beam vector 1012 is found by one or more of maximizing signal intensity or connection strength). The optimum beam vector may change with time as the communication target 922 moves relative to the phased array antenna system.

In the above description, numerous details are set forth. It will be apparent, however, to one of ordinary skill in the art having the benefit of this disclosure, that embodiments may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to convey the substance of their work most effectively to others skilled in the art. An algorithm is used herein, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "determining," "sending," "receiving," "scheduling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments also relate to an apparatus for performing the operations herein. This apparatus may be specially constructed for the required purposes, or it may comprise a general-purpose computer selectively activated or reconfigured by a computer program stored in the computer. Such a computer program may be stored in a computer-readable storage medium, such as, but not limited to, any type of disk including floppy disks, optical disks, Read-Only Memories (ROMs), compact disc ROMs (CD-ROMs) and magnetic-optical disks, Random Access Memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present embodiments are not described with reference to any particular programming language. It will be appreciated that a variety of programming languages may be used to implement the teachings of the present embodiments as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present embodiments should, therefore, be determined with reference to the appended claims, along with the full scope of equivalents to which such claims are entitled.

What is claimed is:

1. A communication system comprising:

a circuit board coupled to a chassis of a space vehicle, the chassis being electrically grounded at a first ground potential and the circuit board comprising a ground plane that is electrically grounded at a second ground potential;

an antenna located on a first surface of the circuit board;

an integrated circuit located on a second surface of the circuit board, the integrated circuit comprising radio frequency (RF) circuitry i) coupled to the antenna through a first via in the circuit board and ii) coupled to the ground plane; and a quarter-wave RF choke implemented in the circuit board, wherein the quarter-wave RF choke provides i) an electrically insulating gap between the ground plane and the chassis at direct current (DC) and ii) an electrical connection between the ground plane and the chassis within a frequency range, wherein the quarter-wave RF choke comprises:

a first planar conductor located in a first layer of the circuit board, the first planar conductor being electrically coupled to the ground plane; and a second planar conductor located in a second layer of the circuit board, the second planar conductor being electrically coupled to the first ground potential, wherein a portion of the first planar conductor and a portion of the second planar conductor overlap horizontally by an effective distance of a quarter wavelength.

2. The communication system of claim 1, wherein the first planar conductor comprises a first circular perimeter, wherein the second planar conductor comprises a second circular perimeter, and wherein the portion of the first planar conductor and the portion of the second planar conductor that overlap horizontally form a region having a circular shape.

3. A communication system comprising:

a circuit board coupled to a chassis, the chassis being electrically grounded at a first ground potential and the circuit board comprising a ground plane that is electrically grounded at a second ground potential, the ground plane located on a first side of the circuit board;

an antenna located on a second side of the circuit board; and a radio frequency (RF) structure comprising:

a first conductor electrically coupled to the ground plane; and a second conductor electrically coupled to the chassis, wherein a physical arrangement of a portion of the first conductor and a portion of the second conductor causes the RF structure to provide an electrically insulating gap between the ground plane and the chassis at direct current (DC) and an electrical connection between the ground plane and the chassis within a frequency range.

4. The communication system of claim 3, wherein the first conductor has an outer edge with a circular shape, wherein the second conductor has an outer edge with a circular shape, wherein the portion of the first conductor and the portion of the second conductor overlap horizontally by an effective distance that is a quarter wavelength of an operating frequency of the antenna.

5. The communication system of claim 3, wherein the first conductor has an outer edge with a circular shape, wherein the second conductor has an outer edge with a circular shape, wherein the portion of the first conductor and the portion of the second conductor overlap horizontally by an effective distance that is a three-quarter wavelength of an operating frequency of the antenna.

6. The communication system of claim 3, wherein the physical arrangement comprises the portion of the first conductor and the portion of the second conductor overlapping horizontally by an effective distance of a quarter wavelength or three-quarter wavelength.

7. The communication system of claim 3, wherein the first conductor is planar and comprises a first circular perimeter, wherein the second conductor is planar and comprises a second circular perimeter, and wherein the portion of the first conductor and the portion of the second conductor overlap horizontally to form a region having a circular shape.

8. The communication system of claim 3, wherein the first conductor is planar and comprises a first rectangular or square perimeter, wherein the second conductor is planar and comprises a second rectangular or square perimeter, and wherein the portion of the first conductor and the portion of the second conductor overlap to form a region having a rectangular shape.

9. The communication system of claim 3, wherein:

the circuit board comprises a first grounding structure located at a third side of the circuit board and a second grounding structure located at a fourth side of the circuit board;

the first grounding structure is physically coupled and electrically coupled to a first DC grounding point on the chassis;

the second grounding structure is physically coupled and electrically coupled to a second DC grounding point on the chassis; and the second conductor is electrically coupled to the first grounding structure and the second grounding structure.

10. The communication system of claim 9, wherein:

the first grounding structure comprises:

a first electrode located on a first surface of the circuit board near the third side, the first surface being on the second side of the circuit board;

a second electrode located on a second surface of the circuit board near the third side, the second surface being on the first side of the circuit board;

a via coupling the first electrode to the second electrode;

the first conductor is planar and is located in a first layer of the circuit board; and the second conductor is planar and is located in a second layer of the circuit board and coupled to the via.

11. The communication system of claim 9, wherein:

the first conductor is planar and is located in a first layer of the circuit board and coupled to a via coupling the first conductor to the ground plane; and the second conductor is planar and is located in a second layer of the circuit board and coupled to the via.

12. The communication system of claim 9, wherein the circuit board comprises:

a first via coupled to the antenna;

a second via coupled to the first conductor and the ground plane; and a third via coupled to the second conductor and the chassis.

13. A space vehicle comprising:

a chassis;

a circuit board coupled to the chassis;

an integrated circuit comprising radio frequency (RF) circuitry coupled to the circuit board;

a ground plane coupled to the circuit board;

an antenna coupled to the RF circuitry; and an RF structure, wherein the RF structure operates as an RF short between the ground plane and the chassis within a frequency range and as an RF open circuit-between the ground plane and the chassis at direct current (DC), wherein the RF structure comprises:

a first conductor electrically coupled to the ground plane; and a second conductor electrically coupled to the chassis, wherein a physical arrangement of a portion of the first conductor and a portion of the second conductor causes the RF structure to provide an electrically insulating gap between the ground plane and the chassis at the DC.

14. The space vehicle of claim 13, wherein the RF structure further comprises:

an electrical connection between the ground plane and the chassis within the frequency range.

15. The space vehicle of claim 14, wherein the physical arrangement comprises the portion of the first conductor and the portion of the second conductor overlapping horizontally by an effective distance of a quarter wavelength or three-quarter wavelength.

16. The space vehicle of claim 14, wherein the first conductor is planar and comprises a first circular perimeter, wherein the second conductor is planar and comprises a second circular perimeter, and wherein the portion of the first conductor and the portion of the second conductor overlap horizontally to form a region having a circular shape.

17. The space vehicle of claim 14, wherein the first conductor is planar and comprises a first rectangular or square perimeter, wherein the second conductor is planar and comprises a second rectangular or square perimeter, and wherein the portion of the first conductor and the portion of the second conductor form a region having a rectangular shape.

18. The space vehicle of claim 14, the circuit board comprises a first grounding structure located at a first side of the circuit board and a second grounding structure located at a second side of the circuit board;

the first grounding structure is physically coupled and electrically coupled to a first DC grounding point on the chassis;

the second grounding structure is physically coupled and electrically coupled to a second DC grounding point on the chassis; and the second conductor is electrically coupled to the first grounding structure and the second grounding structure.

19. The space vehicle of claim 18, wherein:

the first grounding structure comprises:

a first electrode located on a first surface of the circuit board near a third side, the first surface being on the second side of the circuit board;

a second electrode located on a second surface of the circuit board near the third side, the second surface being on the first side of the circuit board; and a via coupling the first electrode to the second electrode;

the first conductor is planar and is located in a first layer of the circuit board; and the second conductor is planar and is located in a second layer of the circuit board and coupled to the via.

20. The space vehicle of claim 18, wherein:

the first conductor is planar and is located in a first layer of the circuit board and coupled to a via coupling the first conductor to the ground plane; and the second conductor is planar and is located in a second layer of the circuit board and coupled to the via.

* * * * *